US010857809B2

(12) United States Patent
Yajima et al.

(10) Patent No.: US 10,857,809 B2
(45) Date of Patent: Dec. 8, 2020

(54) PRINTING DEVICE AND CONTROL METHOD OF A PRINTING DEVICE

(71) Applicant: SEIKO EPSON CORPORATION, Tokyo (JP)

(72) Inventors: Yuki Yajima, Nagano (JP); Yuji Takamizawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/972,464

(22) Filed: May 7, 2018

(65) Prior Publication Data

US 2018/0339523 A1 Nov. 29, 2018

(30) Foreign Application Priority Data

May 29, 2017 (JP) ..... 2017-105211

(51) Int. Cl.
*B41J 2/325* (2006.01)
*B41J 2/32* (2006.01)
*B41J 2/355* (2006.01)

(52) U.S. Cl.
CPC ..... *B41J 2/325* (2013.01); *B41J 2/32* (2013.01); *B41J 2/355* (2013.01)

(58) Field of Classification Search
None
See application file for complete search history.

(56) References Cited

U.S. PATENT DOCUMENTS 5,248,993 A 9/1993 Oshino et al.
6,278,525 B1 * 8/2001 Watanabe ..... B41J 11/70 358/1.13
7,375,846 B2 * 5/2008 Kokubo ..... H04N 1/00204 358/1.16
8,243,291 B2 * 8/2012 Kojima ..... B41J 2/01 347/1
8,482,586 B1 * 7/2013 Martell ..... B41J 2/355 347/180
2008/0084438 A1 4/2008 Sheahan et al.
2016/0279975 A1 * 9/2016 Nakagawa ..... B41J 11/663

FOREIGN PATENT DOCUMENTS

JP 05-024243 A 2/1993

OTHER PUBLICATIONS

The Extended European Search Report for the corresponding European Patent Application No. 18174157.0 dated Oct. 10, 2018.

* cited by examiner

*Primary Examiner* — Alejandro Valencia

(74) *Attorney, Agent, or Firm* — Global IP Counselors, LLP

(57) ABSTRACT

A printer having a printer communicator for receiving commands; a thermal line head that prints in line units on thermal roll paper; a multiple line buffer; and a printer controller that controls the thermal line head to print. When the printer communicator receives an image printing command instructing image printing, the printer controller stores the image data specified by the image printing command in the multiple line buffer. When the printer communicator receives a non-image data definition command, the printer controller prints an image on the thermal roll paper by the thermal line head based on the image data stored in the multiple line buffer.

8 Claims, 5 Drawing Sheets

PRINTING DEVICE AND CONTROL METHOD OF A PRINTING DEVICE

The present application claims priority based on and incorporates by reference the entire contents of Japanese Patent Application No. 2017-105211 filed on 29 May 2017

BACKGROUND

1. Technical Field

The present invention relates to a printing device and a control method of a printing device.

2. Related Art

Printing devices that print on a print medium line by line are known from the literature. See, for example, JP-A-H5-24243.

JP-A-H5-24243 describes a printing device that, when resuming printing after printing stops temporarily, suppresses inserting a white line by determining the drive timing of the thermal head according to the actual movement of the paper and printing multiple times only the first dot line where printing resumes.

The technology described in JP-A-H5-24243, however, requires complicated control to control the timing to drive the printhead, and the number of times to print the first dot line when resuming printing, and depending on the operating environment of the printing device, cannot prevent a drop in print quality because it is predicated on pausing printing.

SUMMARY

An objective of the present invention is to suppress a drop in print quality by a simple control method.

To achieve the foregoing objective, a printing device according to the invention includes: a receiver configured to receive a command; a line head configured to print line by line on a print medium; and a controller configured to control the line head to print. The controller, when a first command instructing image printing is received by the receiver, stores image data specified by the first command to a storage device, and when a second command different from the first command is received by the receiver, prints an image on the print medium by the line head based on the image data stored in the storage device.

By the simple control of storing image data when a first command is received, and printing the stored image data when a second command is received, this configuration can prevent printing stopping temporarily when printing an image, and thereby suppress a drop in print quality.

In a printing device according to another aspect of the invention, the first command includes an image data definition command containing image data, and an execute printing command instructing executing printing; and the controller is configured to count a number of times an execute printing command is received by the receiver, and does not print by the line head when the number of times the execute printing command was received is one time.

When the execute printing command was received once, this configuration does not print by the line head, can therefore store multiple image data objects in the storage device, and when printing an image, can prevent printing stopping temporarily.

In a printing device according to another aspect of the invention, when the second command is received when the number of times an execute printing command was received is two times or more, the controller prints an image on the print medium by the line head based on the image data stored in the storage device.

When the number of times an execute printing command is received is two or more, and a second command is received, this configuration prints an image based on the image data stored in the storage device. As a result, image data stored until a second command is received can be printed continuously, and when printing an image, printing stopping temporarily can be prevented.

In a printing device according to another aspect of the invention, when printing an image on the print medium by the line head based on the image data stored in the storage device, the controller resets the count of the number of times an execute printing command was received.

When an image is printed on the print medium by the line head, this configuration resets the count of the number of times an execute printing command was received. As a result, the next time an image is printed, printing stopping temporarily can be reliably prevented.

In a printing device according to another aspect of the invention, when the second command is received consecutively to the execute printing command, the controller prints an image on the print medium by the line head based on the image data stored in the storage device.

This configuration can continuously print image data stored until a second command is received consecutively to an execute printing command, and when printing an image, can prevent printing stopping temporarily.

In a printing device according to another aspect of the invention, the second command is, at least, a command not including the image data definition command.

This configuration can print images based on image data stored in a storage device by the simple control of receiving a command not containing image data.

In a printing device according to another aspect of the invention, the controller is configured to execute a normal mode to store data for printing one line to the storage device, and print the data for printing by the line head, and a batch print mode to store data for printing multiple lines to the storage device, and print the data for printing by the line head; when the receiver receives the first command, go to the batch print mode and store image data specified by the first command to the storage device, and when the receiver receives the second command, print the image data stored in the storage device by the line head, and then change from the batch print mode to the normal mode.

Because this configuration changes from a normal mode to a batch print mode when printing image data, storing unnecessary data is prevented, and a drop in the print quality of images can be suppressed.

In a printing device according to another aspect of the invention, the line head is a thermal head configured to form an image by applying heat to the print medium.

This configuration can prevent printing stopping temporarily when printing an image, and can thereby suppress white lines or banding in images.

To achieve the foregoing objective, another aspect of the invention is a control method of a printing device according to another aspect of the invention, the printing device including a receiver configured to receive a command, and a line head configured to print line by line on a print medium, and the control method including: storing image data specified by the first command when a first command instructing image printing is received by the receiver; and printing an image on the print medium by the line head based on the stored image data when a second command different from the first command is received by the receiver.

By the simple control of storing image data when a first command is received, and printing the stored image data when a second command is received, this configuration can prevent printing stopping temporarily when printing an image, and thereby suppress a drop in print quality.

Other objects and attainments together with a fuller understanding of the invention will become apparent and appreciated by referring to the following description and claims taken in conjunction with the accompanying drawings.

DESCRIPTION OF EMBODIMENTS

Figure 1:
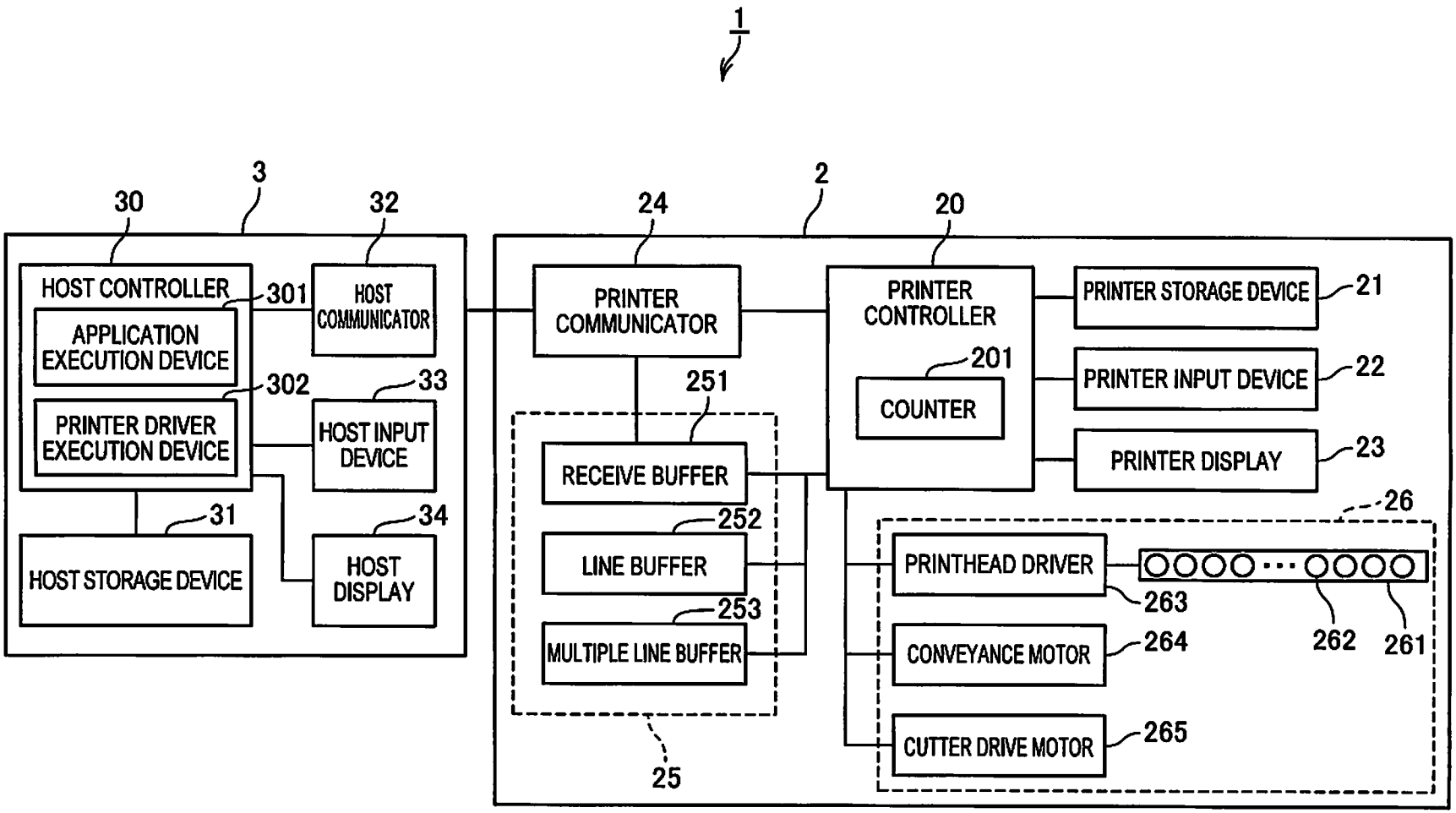
FIG. 1 illustrates the configuration of a printer.

FIG. 1 illustrates the configuration of a printer 2 (printing device).

As shown in FIG. 1, a printing system 1 in this example includes a printer 2 and a host computer 3.

The printer 2 in this example is a thermal printer having a thermal line head 261 (line head) with heat elements 262 arrayed in a line, and prints text and images by applying heat by the thermal line head 261 to the printing surface Ra (see FIG. 2) of thermal roll paper R (print medium).

As shown in FIG. 1, the printer 2 includes a printer controller 20 (controller), printer storage device 21, a printer input device 22, a printer display 23, a printer communicator 24 (receiver), a buffer 25, and a print mechanism 26.

The printer controller 20 includes a CPU, ROM, RAM, ASIC, or other signal processing circuits, and controls other parts of the printer 2. The printer controller 20 executes processes by the cooperation of hardware and software, such as a CPU reading a program stored in ROM or the printer storage device 21 to RAM and executing the program, or executes processes by functions embedded in an ASIC, or executes processes by a signal processing circuit processing signals.

The printer controller 20 also has a counter 201, and is configured to count the number of times an execute printing command IJC described below (see FIG. 3) is received consecutively.

The printer storage device 21 includes nonvolatile memory such as a hard disk drive or EEPROM, and stores data rewritably.

The printer input device 22 is an input means such as an operating panel or touch panel disposed to the printer 2, detects user operation of the input means, and outputs to the printer controller 20. The printer controller 20, based on input from the printer input device 22, then executes processes corresponding to the operation of the input means.

The printer display 23 is a display means such as LEDs or an operating panel, and as controlled by the printer controller 20, drives the LEDs in a specific pattern to light steady, blink, or turn off, or displays information on the display panel.

The printer communicator 24, as controlled by the printer controller 20, communicates with the host computer 3 according to a specific communication protocol. The printer communicator 24 and host computer 3 may communicate wirelessly or by wire.

The buffer 25 is embodied by a semiconductor memory device, for example, and functions as a temporary storage area. As shown in FIG. 1, the buffer 25 includes a receive buffer 251, a line buffer 252 (storage), and a multiple line buffer 253 (storage).

The receive buffer 251, as controlled by the printer controller 20, stores commands received from the host computer 3 by the printer communicator 24. Commands received from the host computer 3 are described below.

The line buffer 252 is a single line print buffer. Note that in this embodiment a "line" is a concept that, in addition to meaning a string of one or more characters printed in one line on the printing surface Ra of the thermal roll paper R, also means one unit of an image that is printed based on image data stored in the line buffer 252. For example, to print one line of text, the printer controller 20 stores font data for all characters in the string printed on one line in the line buffer 252 as image data, and then prints the string on one line based on the image data stored in the line buffer 252. Furthermore, to print one line of an image, the printer controller 20 stores bitmap data of the one line of the image as image data in the line buffer 252, and then prints one line of the image based on the image data stored in the line buffer 252.

The multiple line buffer 253 is a print buffer capable of storing multiple lines of data. Compared with the line buffer 252, the multiple line buffer 253 can store more than one line of data.

The print mechanism 26, as controlled by the printer controller 20, is supplied with drive power and executes printing based on the commands received from the host computer 3. The print mechanism 26 includes a thermal line head 261, a printhead driver 263, a conveyance motor 264, and a cutter drive motor 265.

The thermal line head 261 has multiple heat elements 262 arrayed in the direction intersecting (such as perpendicular to) the conveyance direction of the thermal roll paper R. The thermal line head 261 prints text and images by producing heat by energizing the heat elements 262 and applying heat to the printing surface Ra of the thermal roll paper R.

The printhead driver 263, as controlled by the printer controller 20, controls energizing the heat elements 262 of the thermal line head 261.

The conveyance motor 264, as controlled by the printer controller 20, turns conveyance rollers (not shown in the figure) to convey the thermal roll paper R.

The cutter drive motor 265, as controlled by the printer controller 20, drives a movable knife (not shown in the figure) to slide across a fixed knife (not shown in the figure) and thereby cut the thermal roll paper R.

The host computer 3 is described next. The host computer 3 is a control device that controls the printer 2.

As shown in FIG. 1, the host computer 3 has a host controller 30, a host storage device 31, a host communicator 32, a host input device 33, and a host display 34.

The host controller 30 is embodied by a CPU, ROM, RAM, ASIC, or other signal processing circuits, and controls other parts of the host computer 3. The host controller 30 executes processes by the cooperation of hardware and software, such as a CPU reading a program stored in ROM or the host storage device 31 to RAM and executing the program, or executes processes by functions embedded in an ASIC, or executes processes by a signal processing circuit processing signals. The host controller 30, by reading and running a control program stored in ROM or the host storage device 31, functions as the application execution device 301 or the printer driver execution device 302 described below.

Host storage device 31 includes nonvolatile memory such as a hard disk drive or EEPROM, and stores data rewritably.

The host communicator 32, as controlled by the host controller 30, communicates with the printer 2 according to a specific communication protocol.

The host input device 33 is an input means such as operating switches, a touch panel, a mouse, or a keyboard disposed to the host computer 3, detects user operation of the input means, and outputs to the host controller 30. The host controller 30, based on input from the host input device 33, then executes processes corresponding to the operation of the input means.

The host display 34 is a display means such as LEDs or an operating panel, and as controlled by the host controller 30, drives the LEDs in a specific pattern to light steady, blink, or turn off, or displays information on the display panel.

The host controller 30 includes an application execution device 301 and a printer driver execution device 302.

The application execution device 301, by executing a previously installed application (not shown in the figure), executes a process of generating data for the text or images to print on the printing surface Ra of the thermal roll paper R.

The printer driver execution device 302, by executing a previously installed printer driver (not shown in the figure), generates and sends to the printer 2 control commands corresponding to the command language of the printer 2. Note that the control commands are commands causing the printer 2 to execute operations such as printing text and images, and cutting the thermal roll paper R, and may include commands instructing printing a string, commands instructing printing an image, commands instructing conveying the thermal roll paper R a specific amount, and commands instructing cutting the thermal roll paper R.

The printing system 1 in this example is used in a POS (Point Of Sale) system. A POS system is a system used in the retail industry such as in shopping centers, department stores, convenience stores, and food cart sales, and the food service industry in restaurants, cafes, and bar restaurants, for example. A POS system has functions for processing payment transactions based on the products purchased by a customer, and for printing transaction receipts. In general, strings such as the product name, product price, subtotal, and transaction total, an image of the logo of the store that produced the receipt, and images such as codes for acquiring coupons (barcodes or QR codes (R), for example), are commonly printed on a receipt. Such images may be printed using multiple lines (across multiple lines) on the printing surface Ra of the thermal roll paper R.

To print a single image over multiple lines on the printing surface Ra of the thermal roll paper R, the host computer 3 divides the single image into segments, and generates and sends control commands for each image segment into which the image was divided based on the image data in the particular segment to the printer 2.

A command including the image data of an image including image segments, and the control commands generated based on the image data, is referred to below as an image printing command IC (first command) (see FIG. 3).

The printer 2 receives an image printing command IC for each image segment, and prints the one image on the printing surface Ra of the thermal roll paper R by executing the operation described below.

Figure 2:
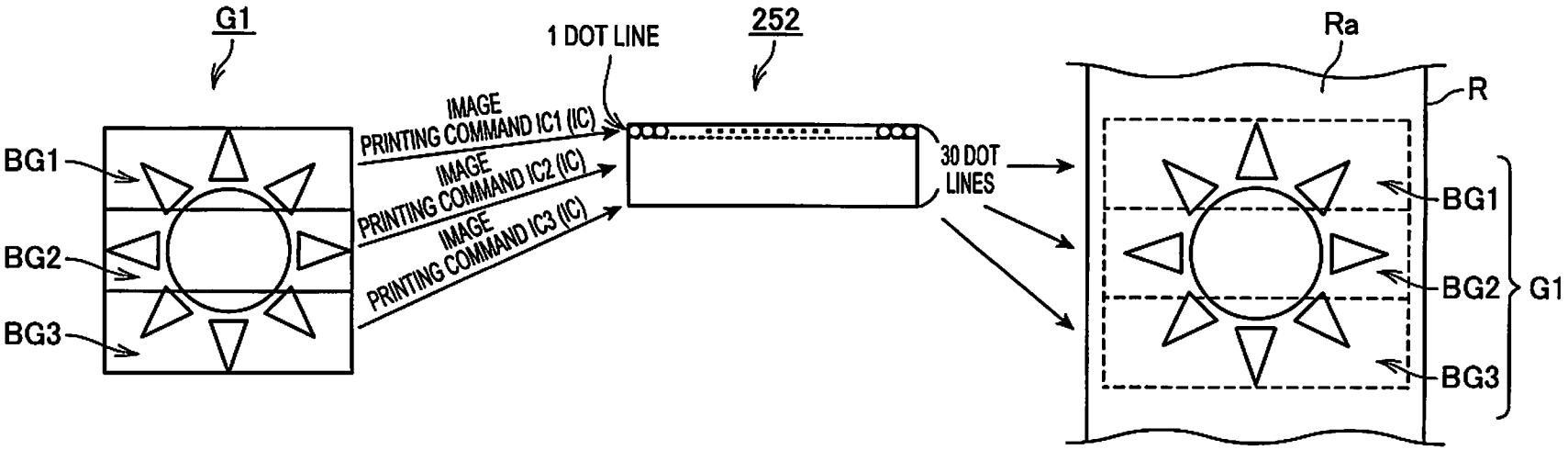
FIG. 2 describes printing a segmented image.

FIG. 2 is used to describe printing image segments based on an image printing command IC.

Printing image G1 on the printing surface Ra of the thermal roll paper R is described below with reference to FIG. 2.

The application execution device 301 of the host controller 30 of the host computer 3 divides the image G1 into image segment BG1, image segment BG2, and image segment BG3. Note that the image data of image segment BG1, image segment BG2, and image segment BG3 is, for example, data with information about each pixel, such as bitmap data, and is data of a size that can be stored in the line buffer 252.

When the application execution device 301 has generated image data for image segment BG1 to image segment BG3, the application execution device 301 sends the generated image data to the printer driver execution device 302 in the order of image data for image segment BG1, the image data for image segment BG2, and the image data for image segment BG3.

The printer driver execution device 302 generates and sends to the printer 2, in the order of the input image data, control commands instructing printing the image segment based on the image data, and an image printing command IC (FIG. 3) including the image data and the control commands. In the example in FIG. 2, the printer driver execution device 302 sequentially generates image printing command IC1, image printing command IC2, and image printing command IC3, and sequentially sends the commands to the printer 2.

Note that image printing command IC1 is an image printing command IC including the image data for image segment BG1 and a control command instructing printing image segment BG1. Likewise, image printing command IC2 is an image printing command IC including the image data for image segment BG2 and a control command instructing printing image segment BG2. Likewise, image printing command IC3 is an image printing command IC including the image data for image segment BG3 and a control command instructing printing image segment BG3.

Figure 3:
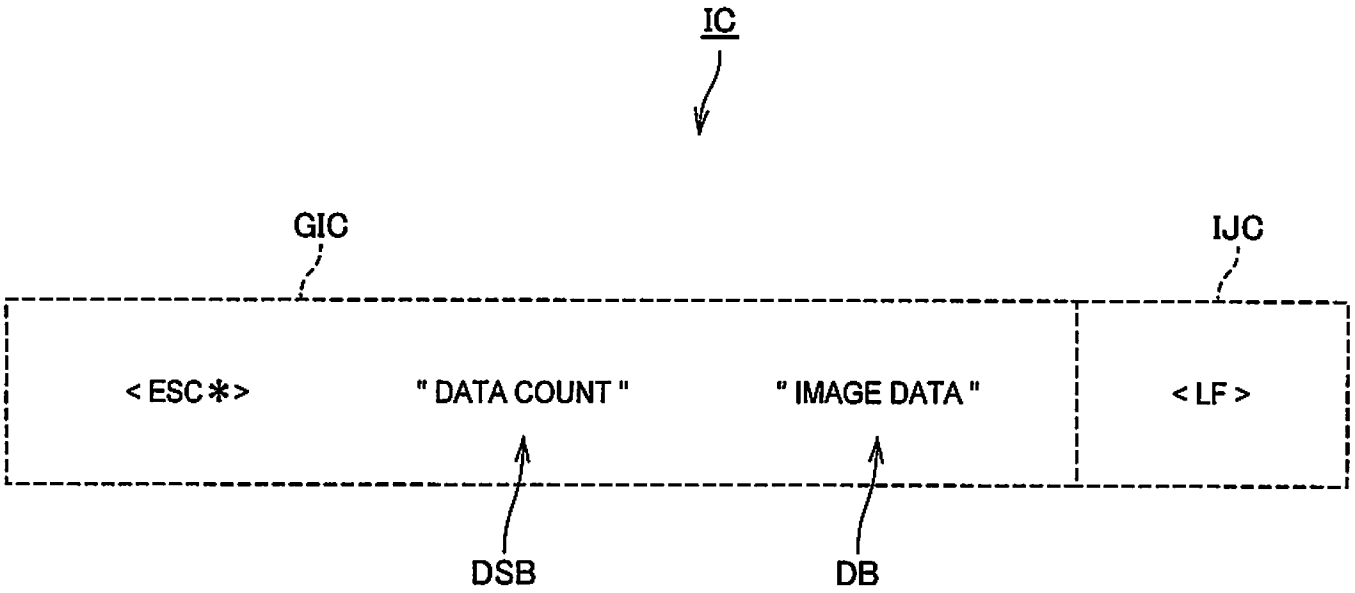
FIG. 3 shows an example of an image printing command.

FIG. 3 shows an example of an image printing command IC.

As shown in FIG. 3, an image printing command IC includes at least an image data definition command GIC and an execute printing command IJC. The image data definition command GIC and execute printing command IJC are examples of the control commands described above.

An image data definition command GIC includes at least a data packet DB storing image data, and a data count DSB storing the data count (data length) of the image data stored in the data packet DB. The image data definition command GIC is a command instructing storing the image data specified by the image data definition command GIC, or in other words, the image data stored in the data packet DB, to the line buffer 252 or multiple line buffer 253. The execute printing command IJC, in the example in FIG. 3, is a command instructing printing an image based on the image data stored in the line buffer 252 or multiple line buffer 253. As shown in FIG. 3, when an execute printing command IJC is included in the image printing command IC, the execute printing command IJC instructs executing printing an image based on the image data stored in the line buffer 252 or multiple line buffer 253 (the image data the image data definition command GIC contains).

For example, when the image printing command IC is image printing command IC1, the image printing command IC1 stores image data for image segment BG1 in the data packet DB (specifies the image data of image segment BG1 as the data packet DB), and instructs printing image segment BG1.

When the image printing command IC is image printing command IC2, the image printing command IC2 stores image data for image segment BG2 in the data packet DB (specifies the image data of image segment BG2 as the data packet DB), and instructs printing image segment BG2.

When the image printing command IC is image printing command IC3, the image printing command IC2 stores image data for image segment BG3 in the data packet DB (specifies the image data of image segment BG3 as the data packet DB), and instructs printing image segment BG3.

Below, the image data definition command GIC image printing command IC1 contains is referred to as image data definition command GIC1, the image data definition command GIC image printing command IC2 contains is referred to as image data definition command GIC2, the image data definition command GIC image printing command IC3 contains is referred to as image data definition command GIC3.

In addition below, the execute printing command IJC the image printing command IC1 contains is referred to as execute printing command IJC1, the execute printing command IJC the image printing command IC2 contains is referred to as execute printing command IJC2, the execute printing command IJC the image printing command IC3 contains is referred to as execute printing command IJC3.

Referring again to FIG. 2, when the printer controller 20 of the printer 2 receives an image printing command IC by the printer communicator 24, it stores the received image printing command IC in the receive buffer 251. When image printing command IC1, image printing command IC2, and image printing command IC3 are received in sequence, the printer controller 20 stores the image printing commands IC to the receive buffer 251 in the order received.

When an image printing command IC is stored in the receive buffer 251, the printer controller 20 sequentially reads the image data definition command GIC and execute printing command IJC the image printing command IC contains from the receive buffer 251 in the order the image printing commands IC were stored.

First, the printer controller 20 reads the image data definition command GIC, and stores the image data the image data definition command GIC contains to the line buffer 252. Note that storing image data to the line buffer 252 means that drive data (data for printing) based on the image data is rendered and stored in the line buffer 252.

Drive data is data for controlling driving the heat elements 262 of the thermal line head 261 according to the pixels of the image indicated by the image data.

FIG. 2 shows an example in which the size of the data that the line buffer 252 can store is 30 dot lines.

A dot line indicates data corresponding to a line of heat elements 262 of the thermal line head 261, or a unit of the image.

More specifically, in this embodiment of the invention, a line of heat elements 262 comprises 512 heat elements 262 extending in a direction crossing the conveyance direction of the thermal roll paper R. Note that the longitudinal direction is the direction corresponding to the conveyance direction, and the transverse direction is the direction in which the heat elements 262 form a line. Based thereon, the size of data the line buffer 252 can store is the size of data corresponding to 30 dots in the longitudinal direction by 512 dots in the transverse direction. Therefore, when segmenting the image G1 into image segment BG1 to image segment BG3, the application execution device 301 segments the image data so that the size of the image data in each image segment BG1 to image segment BG3 is less than or equal to the size of 30 dots longitudinally by 512 dots transversely that can be stored in the line buffer 252.

In the example in FIG. 2, because image printing command IC1, image printing command IC2, and image printing command IC3 are received in order, the printer controller 20 first reads image printing command IC1 from the receive buffer 251, and stores the image data for image segment BG1 in the line buffer 252. In other words, the printer controller 20 renders and stores in the line buffer 252 drive data based on the image data for image segment BG1. When the printer controller 20 stores the image data for image segment BG1 in the line buffer 252, the printer controller 20 reads the execute printing command IJC and controls the print mechanism 26 to print image segment BG1 on the printing surface Ra of the thermal roll paper R.

More specifically, the printer controller 20 references the drive data based on the image data for image segment BG1 stored in the line buffer 252 while conveying the thermal roll paper R in the conveyance direction, outputs the drive signals to the heat elements 262 while synchronizing to the timing adjustment signal, and sequentially prints the image one dot line at a time. In this way, the printer controller 20 prints image segment BG1 by sequentially printing, for all dot lines in the image data, an image based on each dot line Once the printer controller 20 has printed image segment BG1 on the printing surface Ra of the thermal roll paper R, the printer controller 20 clears the line buffer 252, and sequentially reads the image data definition command GIC and execute printing command IJC that image printing command IC2 contains from the receive buffer 251. The printer controller 20 then stores the image data for image segment BG2 to the line buffer 252 in the same way as for image printing command IC1, and prints image segment BG2 on the printing surface Ra of the thermal roll paper R. Once image segment BG2 is printed, the printer controller 20 clears the line buffer 252, and prints image segment BG3 on the printing surface Ra of the thermal roll paper R in the same way.

As described above, the printer controller 20 prints image G1 on the printing surface Ra of the thermal roll paper R by sequentially printing image segment BG1 to image segment BG3.

When printing an image G1 to the thermal roll paper R, white lines or banding can appear in the printed image G1. For example, after printing image segment BG1 on the thermal roll paper R, image printing command IC2 containing the image data for image segment BG2 must be stored in the receive buffer 251 to print image segment BG2 on the thermal roll paper R. However, if the reception speed of image printing command IC2 from the host computer 3 is slower than the print speed at which the image segment BG1 is printed, image printing command IC2 may not be stored in the receive buffer 251 by the time image segment BG1 is printed.

In this event, if image printing command IC2 is not stored in the receive buffer 251, the printer controller 20 must print intermittently, that is, pause conveying the thermal roll paper R and printing on the thermal roll paper R at least until the image printing command IC2 is stored in the receive buffer 251, and then start printing again after the image printing command IC2 is stored. As known from the literature, intermittent printing is prone to producing white lines or banding due, for example, to deviation in the printing position due to gear backlash, and depending on the temperature environment of the printer 2, the time required for the heat elements 262 to reach the printing temperature. In other words, in this example, a white line can result between image segment BG1 and image segment BG2.

Because white lines degrade the appearance of the printed image, print quality can drop when white lines appear. More particularly, if white lines occur in the image representing a code for acquiring a coupon, for example, reading the code correctly may not be possible.

Methods of preventing intermittent printing include, for example, changing the print speed or changing the reception speed of image printing commands IC from the host computer 3, and changing the amount of image data an image printing command IC contains. However, these changes must often be made by the user, which can increase the burden on the user. Furthermore, while technologies for suppressing the occurrence of white lines are known from the literature, those technologies assume printing is intermittent, or are technologies that require complicated mechanical control.

There is, therefore, a need to easily prevent the occurrence of white lines, and thereby prevent a drop in the print quality of images.

A printer 2 according to this embodiment therefore operates as described below.

Figure 4:
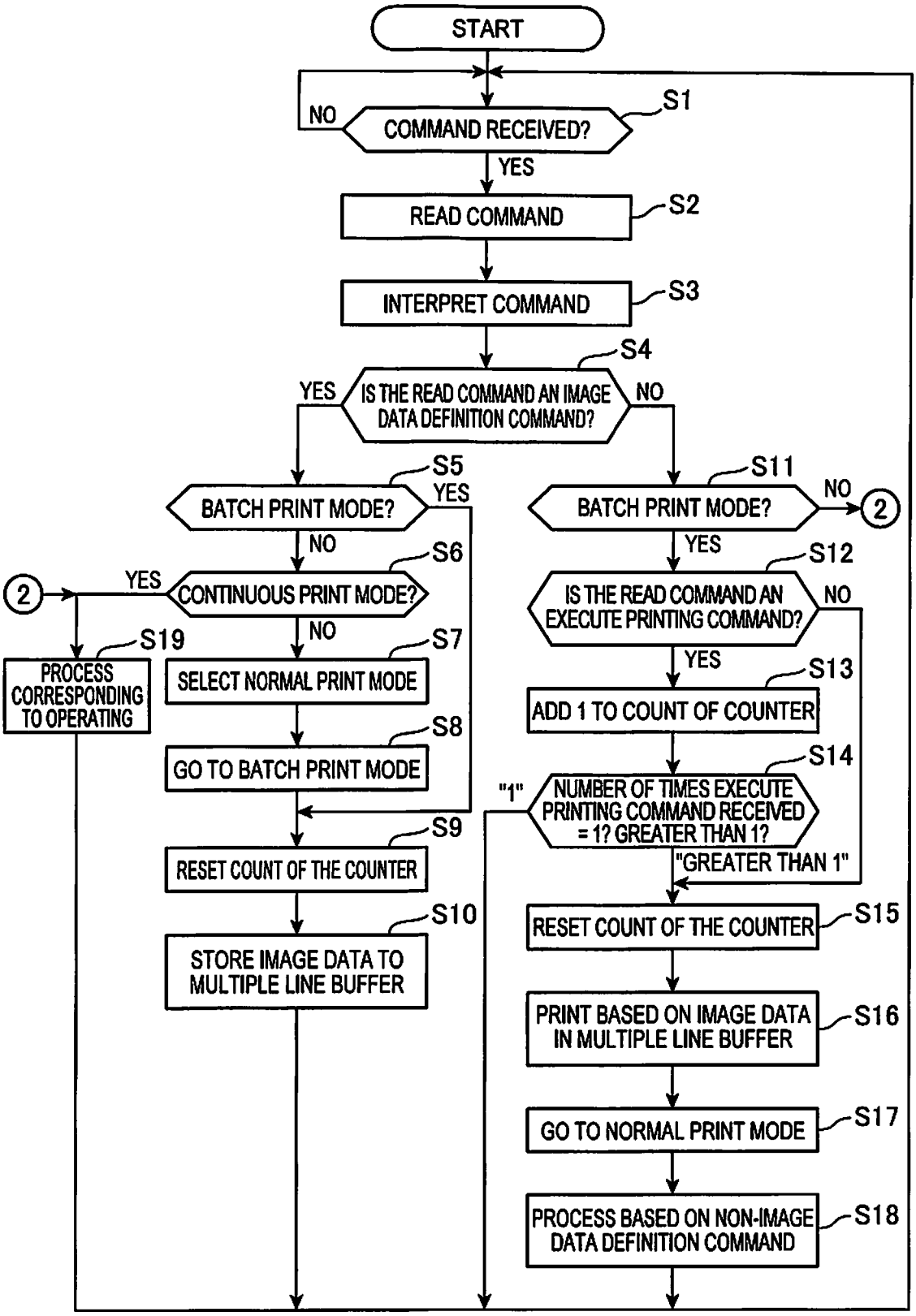
FIG. 4 is a flow chart describing printer operation.

FIG. 4 is a flow chart showing the operation of the printer 2.

The printer controller 20 of the printer 2 determines whether or not a command was received from the host computer 3 (step S1). If the printer controller 20 determines a command was not received from the host computer 3 when a command is not stored in receive buffer 251 (step S1: NO), the printer controller 20 returns to step S1 and continues monitoring whether or not a command was received.

Note that the printer controller 20 may determine whether or not a command was received from the host computer 3 by image printing command IC units, or determine whether or not a command was received from the host computer 3 in single command units, such as an image data definition command GIC.

However, when a command is stored in the receive buffer 251 and the printer controller 20 determines that a command was received from the host computer 3 (step S1: YES), the printer controller 20 reads the command from the receive buffer 251 (step S2). When multiple commands are stored in the receive buffer 251, the printer controller 20 reads the commands in the order they were stored to the receive buffer 251. If the read command is a single command, and the image printing command IC contains an image data definition command GIC and an execute printing command JIC, for example, the single command is either the image data definition command GIC or the execute printing command JIC.

The printer controller 20 then interprets the command that was read (step S3), and determines if the read command is an image data definition command GIC (step S4). For example, the printer controller 20 determines, based on the command code of the command, if the command read from the receive buffer 251 is an image data definition command GIC.

Next, if the printer controller 20 determines the command read from the receive buffer 251 is an image data definition command GIC (step S4: YES), the printer controller 20 determines if the operating mode is the batch print mode (step S5). The batch print mode is an operating mode for printing images by storing multiple lines of image data to the multiple line buffer 253, and when a condition described below is satisfied, printing the complete image based on the multiple lines of image data stored in the multiple line buffer 253 with the thermal line head 261.

If the printer controller 20 determines the operating mode is not set to the batch print mode (step S5: NO), the printer controller 20 determines if the operating mode is the continuous print mode (step S6). The continuous print mode (page mode) is an operating mode for printing images and text by storing print data for multiple lines to the multiple line buffer 253, and then printing by the thermal line head 261.

When the printer controller 20 determines the operating mode is the continuous print mode (step S6: NO), the process goes to step S19, and the printer controller 20 executes the process corresponding to the operating mode based on commands read from the receive buffer 251 (step S19).

However, if the printer controller 20 determines the operating mode is not the continuous print mode (step S6: YES), the printer controller 20 determines the operating mode is the normal print mode (normal mode) (step S7).

The normal print mode is a mode for storing one line of print data in the line buffer 252 and then printing by the thermal line head 261.

In this embodiment of the invention, the printer controller 20 selects either the batch print mode, continuous print mode, or normal print mode as the operating mode. Therefore, by determining in step S5 that the operating mode is not the batch print mode, and determining in step S6 that the operating mode is not the continuous print mode, the printer controller 20 can determine that the operating mode is the normal print mode.

If the printer controller 20 determines the operating mode is the normal print mode, it changes the operating mode from the normal print mode to the batch print mode (step S8).

Next, when the operating mode goes to the batch print mode, the printer controller 20 resets the count of the counter 201 to 0, for example (step S9).

Next, after resetting the count of the counter 201, the printer controller 20 stores the image data contained in the image data definition command GIC to the multiple line buffer 253 (step S10). Note that storing image data to the multiple line buffer 253, like storing image data to the line buffer 252, means rendering and storing drive data based on the image data to the multiple line buffer 253. More specifically, the printer controller 20 renders and stores drive data based on the image data the image data definition command GIC contains to the multiple line buffer 253.

Referring again to the description of step S5 in FIG. 4,

Referring again to the description of step 5 in FIG. 4, when the printer controller 20 determines the operating mode is the batch print mode (step S5: YES), the printer controller 20 resets the count of the counter 201 (step S9), and stores the image data the image data definition command GIC contains to the multiple line buffer 253 (step S10).

After executing step S10, the printer controller 20 returns the process to step S1.

Referring again to the description of step 4 in FIG. 4, when the printer controller 20 determines the command that was read is not the image data definition command GIC (step S4: NO), it determines if the operating mode is the batch print mode (step S11). Below, a command that is not an image data definition command GIC, in other words, a command that does not include at least an image data definition command GIC, is referred to as a non-image data definition command (second command). A non-image data definition command includes, for example, execute printing commands IJC, commands instructing executing printing a text string, and commands instructing cutting the thermal roll paper R.

If the printer controller 20 determines in step S11 that the operating mode is not the batch print mode (step S11: NO), the process goes to step S19, and based on the command read from the receive buffer 251, executes the process corresponding to the operating mode (step S19).

If the printer controller 20 determines in step S11 that the operating mode is the batch print mode (step S11: YES), it determines if the command read in step S2 is an execute printing command IJC (step S12). If the printer controller 20 determines the command read in step S2 is not an execute printing command IJC (step S12: NO), the process goes to step S15. However, if the printer controller 20 determines the command read in step S2 is an execute printing command IJC (step S12: YES), it determines an execute printing command IJC was received and increments the count of the counter 201 one, that is, the printer controller 20 adds one to the current count of the counter 201 (step S13).

Next, the printer controller 20 determines if the current count of the counter 201 is 1 or a value greater than 1 (step S14). In other words, the printer controller 20 determines if an execute printing command IJC was received once or more than once (step S14).

When the counter 201 in this embodiment is reset, the count is set to 0 (zero), and when an execute printing command IJC is received, the count is incremented by 1. Therefore, because one is added to the count in step S13, the count of the counter 201 being a value greater than 1 in step S14 means that the count of the counter 201 is a value greater than or equal to 2.

If the printer controller 20 determines the count of the counter 201 is 1 (step S14: 1), the 20 returns the process to step S1 without printing by the thermal line head 261.

However, if the printer controller 20 determines the count of the counter 201 is a value greater than 1 (step S14: greater than 1), it resets the count of the counter 201 (step S15).

As described above, when the printer controller 20 reads an image data definition command GIC, it resets the count of the counter 201. Therefore, the printer controller 20 determining the count of the counter 201 is a value greater than 1 means that an execute printing command IJC was received consecutively twice.

Next, the printer controller 20, based on the image data stored in the multiple line buffer 253, prints an image on the printing surface Ra of the thermal roll paper R by means of the print mechanism 26 (step S16).

After printing an image based on the image data stored in the multiple line buffer 253, the printer controller 20 changes the operating mode from the batch print mode to the normal print mode (step S17), and executes the process based on a non-image data definition command (step S18).

Figure 5:
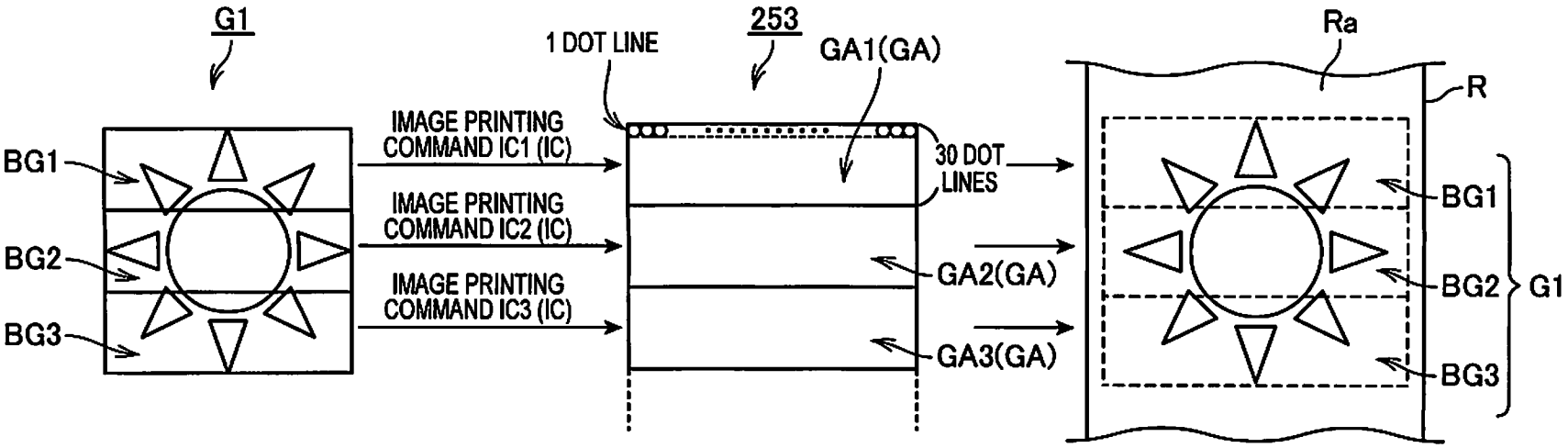
FIG. 5 describes printing a segmented image.

The operation of the printer 2 described above is described more specifically with reference to FIG. 5.

FIG. 5 illustrates printing image segments based on an image printing command IC.

Like FIG. 2, FIG. 5 illustrates printing an image G1 on the printing surface Ra of the thermal roll paper R. As in FIG. 2, in the description referring to FIG. 5, the application execution device 301 divides the image G1 into image segment BG1, image segment BG2, and image segment BG3, and generates image data for each image segment BG1 to image segment BG3. As described above, the printer driver execution device 302 outputs the image printing commands IC to the printer 2 in the order image data is input from the application execution device 301. Therefore, in FIG. 5, as in FIG. 2, the printer driver execution device 302 sequentially generates and sequentially sends image printing command IC1, image printing command IC2, and image printing command IC3 to the printer 2.

In the operation described with reference to FIG. 5 below, when operation of the printer 2 starts, the operating mode is set to the normal print mode. Furthermore, in the description using FIG. 5, image printing commands IC are sequentially stored to the receive buffer 251 in the order image printing command IC1, image printing command IC2, and image printing command IC3.

When image printing command IC1 is stored in the receive buffer 251, the printer controller 20 reads the image data definition command GIC1 the image printing command IC1 contains (step S2). When the image data definition command GIC1 is read, the printer controller 20 changes the operating mode from the normal print mode to the batch print mode (step S8).

When the operating mode goes to the batch print mode, the printer controller 20 resets the count of the counter 201 (step S9), and stores the image data of the image segment BG1 that image data definition command GIC1 contains to the multiple line buffer 253 (step S10).

The multiple line buffer 253 shown in FIG. 5 has multiple line areas GA. The line areas GA shown in FIG. 5 are capable of storing data of the size of 30 dot lines of data. As described above, in this embodiment a line of heat elements 262 comprises 512 heat elements 262 arrayed in the direction intersecting the conveyance direction of the thermal roll paper R. As a result, the size of data each line area GA in the multiple line buffer 253 can store is the size of data corresponding to 30 dots by 512 dots. In this embodiment, the maximum size of image data contained in an image data definition command GIC contained in an image printing command IC is 30 dots longitudinally by 512 dots transversely. Therefore, for brevity in this embodiment of the invention, the size of data that can be stored in each line area GA is the same. Note that the size of the line areas GA in the longitudinal direction is actually determined based on the image data that is stored, and the size of all line areas GA in the longitudinal direction is therefore not necessarily the same.

As shown in FIG. 5, the printer controller 20 stores the image data of image segment BG1 to line area GA1 in multiple line buffer 253.

When the image data of image segment BG1 is stored in the multiple line buffer 253, the printer controller 20 reads the execute printing command IJC1 the image printing command IC1 contains from the receive buffer 251 (step S2). When execute printing command IJC1 is read, the printer controller 20 increments the count of the counter 201 by 1 (step S13). Because the printer controller 20 resets the count of the counter 201 when storing the image data of image segment BG1 to the multiple line buffer 253, the count of the counter 201 goes to 1 as a result of incrementing the count by 1 in this step. Because the count of the counter 201 is 1, the printer controller 20 determines the number of times an execute printing command IJC was received is 1 (step S14: 1), returns the process to step S1 without executing printing based the image data of image segment BG1 stored in the multiple line buffer 253, and reads the next command from the receive buffer 251.

In this way the printer controller 20 is configured to count by the counter 201 the number of times an execute printing command IJC is received, and not print by the thermal line head 261 when the number of times an execute printing command IJC is received is 1. As a result, because the image segment BG1 is not printed on the printing surface Ra of the thermal roll paper R, printing will not be stopped temporarily until printing image segment BG2 can start after printing image segment BG1 due to the print speed or data communication (reception) speed, for example. More specifically, the printer controller 20 can prevent intermittent printing and can prevent a drop in the print quality of the image G1. Furthermore, because the printer controller 20 does not print image segment BG1, the image data of image segment BG2 can be stored to the multiple line buffer 253 continuously after storing the image data of image segment BG1. Therefore, the printer controller 20 can prevent intermittent printing and can prevent a drop in the print quality of the image G1.

Next, the printer controller 20, after the receive buffer 251 stores image printing command IC2, reads the image data definition command GIC2 the image printing command IC2 contains (step S2). Because the image data definition command GIC2 is read after executing image data definition command GIC1, the operating mode is the batch print mode. As a result, the printer controller 20 determines the operating mode is the batch print mode (step S5: YES), and resets the count of the counter 201 (step S9). Because the count of the counter 201 is reset in this step, the printer controller 20 does not determine that an execute printing command IJC was received twice consecutively in step S14 even when execute printing command IJC2 is read after image data definition command GIC2.

When the printer controller 20 resets the count of the counter 201, the printer controller 20 stores the image data of the image segment BG2 the image data definition command GIC2 contains to the multiple line buffer 253 (step S10).

As shown in FIG. 5, the printer controller 20 stores the image data of image segment BG2 using the next dot line after the line area GA1 storing the image data for image segment BG1 as the dot line from which to store the image data of image segment BG2. As described above, because the image data of each image segment BG1 to image segment BG3 is image data for an area 30 dots by 512 dots, the printer controller 20 stores the image data of image segment BG2 to line area GA2 in the multiple line buffer 253. By thus storing the image data of image segment BG2, the multiple line buffer 253 stores both image data for image segment BG1 and image data for image segment BG2.

When the image data of image segment BG2 is stored in the multiple line buffer 253, the printer controller 20 reads the execute printing command IJC2 the image printing command IC2 contains from the receive buffer 251 (step S2). When execute printing command IJC2 is read, the printer controller 20 increments the count of the counter 201 by 1 (step S13). When the printer controller 20 reads image data definition command GIC2, the printer controller 20 sets the count of the counter 201 to 0. As a result, by incrementing the count by one, the count of the counter 201 goes to 1 again. Because the count of the counter 201 is now 1, the printer controller 20 determines the number of times an execute printing command IJC was received is 1 (step S14: 1), and reads the next command from the receive buffer 251 without executing printing based the image data of image segment BG1 and the image data of image segment BG2 stored in the multiple line buffer 253.

In this way, because the count of the counter 201 is reset when image data definition command GIC2 is read, the printer controller 20 does not print by the thermal line head 261 when execute printing command IJC2 is read. As a result, because image segment BG1 and image segment BG2 are not printed on the printing surface Ra of the thermal roll paper R, printing will not be stopped temporarily until printing image segment BG3 can start after printing image segment BG1 and image segment BG2 due to the print speed or data communication (reception) speed, for example. More specifically, the printer controller 20 can prevent intermittent printing and can prevent a drop in the print quality of the image G1. Furthermore, because the printer controller 20 does not print image segment BG1 and image segment BG2, the image data of image segment BG3 can be stored to the multiple line buffer 253 continuously after storing the image data of image segment BG1 and the image data of image segment BG2. Therefore, the printer controller 20 can prevent intermittent printing and can prevent a drop in the print quality of the image G1.

Next, the printer controller 20, after the receive buffer 251 stores image printing command IC3, reads the image data definition command GIC3 the image printing command IC3 contains (step S2). Because the image data definition command GIC3 is read after executing image data definition command GIC2, the operating mode is the batch print mode. As a result, the printer controller 20 determines the operating mode is the batch print mode (step S5: YES), and resets the count of the counter 201 (step S9). Because the count of the counter 201 is reset in this step, the printer controller 20 does not determine that an execute printing command IJC was received twice consecutively in step S14 even when execute printing command IJC3 is read after image data definition command GIC3.

When the printer controller 20 resets the count of the counter 201, the printer controller 20 stores the image data of the image segment BG3 the image data definition command GIC3 contains to the multiple line buffer 253 (step S10).

As shown in FIG. 5, the printer controller 20 stores the image data of image segment BG3 using the next dot line after the line area GA2 storing the image data for image segment BG2 as the dot line from which to store the image data for image segment BG3. As described above, because the image data of each image segment BG1 to image segment BG3 is image data for an area 30 dots by 512 dots, the printer controller 20 stores the image data of image segment BG3 to line area GA3 in the multiple line buffer 253. By thus storing the image data of image segment BG3, the multiple line buffer 253 stores image data for image segment BG1, image data for image segment BG2, and image data for image segment BG3.

When the image data of image segment BG3 is stored in the multiple line buffer 253, the printer controller 20 reads the execute printing command IJC3 the image printing command IC3 contains from the receive buffer 251 (step S2). When execute printing command IJC3 is read, the printer controller 20 increments the count of the counter 201 by 1 (step S13). When the printer controller 20 reads image data definition command GIC3, the printer controller 20 sets the count of the counter 201 to 0. As a result, by incrementing the count by one, the count of the counter 201 goes to 1 again. Because the count of the counter 201 is now 1, the printer controller 20 determines the number of times an execute printing command IJC was received is 1, and reads the next command from the receive buffer 251 without executing printing based the image data of image segment BG1 to image segment BG3 stored in the multiple line buffer 253.

This example supposes that a non-image data definition command is received after the image printing command IC3 is received. More specifically, after reading the execute printing command IJC3 the image printing command IC3 contains, a non-image data definition command is read from the receive buffer 251.

For example, if the non-image data definition command is an execute printing command IJC instructing executing printing and executing a line feed, the printer controller 20 determines the non-image data definition command read from the receive buffer 251 is an execute printing command IJC (step S12: YES), and increments the count of the counter 201 by 1 (step S13). If after reading the execute printing command IJC3 an execute printing command IJC, which is a non-image data definition command, is read, the count of the counter 201 is not reset and therefore goes to 2 when incremented in step S13. The printer controller 20 therefore determines the number of times an execute printing command IJC was received is greater than 1 (step S14: greater than 1), and resets the count of counter 201 (step S15).

Next, the printer controller 20, based on the image data of image segment BG1 to image segment BG3 stored in the multiple line buffer 253, prints image segment BG1 to image segment BG3 on the printing surface Ra of the thermal roll paper R by the thermal line head 261 (step S16).

In step S16, because the multiple line buffer 253 stores the image data for image segment BG1 to image segment BG3, the printer controller 20 can print image segment BG1 to image segment BG3 continuously, preventing intermittent printing. Therefore, because the printer controller 20 can prevent white lines occurring in the image G1, a drop in the print quality of the image G1 can be prevented. Note that in this example the condition used in the batch print mode described above is receiving execute printing commands IJC twice consecutively. When the printer controller 20 prints image segment BG1 to image segment BG3, it changes the operating mode from the batch print mode to the normal print mode (step S17), and executes a non-image data definition command (step S18). More specifically, the printer controller 20 executes a line feed (advancing the thermal roll paper R) after printing the image G1.

In addition, when the non-image data definition command is a non-image data definition command instructing executing a text string, the printer controller 20 determines the non-image data definition command read from the receive buffer 251 is not an execute printing command IJC (step S12: NO), and resets the count of the counter 201 (step S15).

The printer controller 20 then prints the image segment BG1 to image segment BG3 on the printing surface Ra of the thermal roll paper R by the thermal line head 261 (step S16). More specifically, when the printer controller 20 receives an execute printing command IJC followed by a non-image data definition command instructing printing a text string, it prints an image G1 based on the image data stored in the multiple line buffer 253. As described above, the printer controller 20 can print image segment BG1 to image segment BG3 continuously without intermittent printing. Therefore, the printer controller 20 can prevent white lines occurring in the image G1, and a drop in the print quality of the image G1 can be prevented.

Note that in this example the condition used in the batch print mode described above is that a non-image data definition command that is not an execute printing command IJC is received consecutively to an execute printing command IJC.

When the printer controller 20 prints image segment BG1 to image segment BG3, it changes the operating mode from the batch print mode to the normal print mode (step S17), and executes a non-image data definition command (step S18). More specifically, the printer controller 20 stores font data indicating the text string to the line buffer 252, and executing printing the string. As a result, the printer controller 20 can print a text string after printing an image G1 without white lines or banding.

In addition, if, for example, the non-image data definition command is a command instructing cutting the thermal roll paper R, the printer controller 20 determines the non-image data definition command read from the receive buffer 251 is not an execute printing command IJC (step S12: NO), and resets the count of the counter 201 (step S16).

Next, the printer controller 20, based on the image data of the image segment BG1 to image segment BG3 stored in the multiple line buffer 253, prints image segment BG1 to image segment BG3 on the printing surface Ra of the thermal roll paper R by the thermal line head 261. (step S16). When the printer controller 20 prints image segment BG1 to image segment BG3, it changes the operating mode from the batch print mode to the normal print mode (step S17), and executes a non-image data definition command (step S18). More specifically, the printer controller 20 can cut the thermal roll paper R after printing an image G1.

As described above, when the printer controller 20 receives an image printing command IC, the printer controller 20 stores the image data the image data definition command GIC contains in a multiple line buffer 253, and when a non-image data definition command is received, prints an image based on the image data stored in the multiple line buffer 253. As a result, the printer controller 20 can print images without intermittent printing, and can prevent white lines caused by intermittent printing. Therefore, the printer controller 20 can prevent a drop in the print quality of the image. More particularly, producing white lines in an image representing a code when the image is a code for acquiring a coupon, for example, can be prevented, and the printer controller 20 can prevent such problems as the code becoming unreadable.

Furthermore, because a drop in the print quality of the image can be prevented even without the user needing to change the print speed, data communication rate, or the size of the image data, the printer controller 20 does not burden the user.

In addition, because image data is stored and printing is executed according to the type of command, the printer controller 20 can reliably prevent a drop in the print quality of images by a simple control process not requiring complicated mechanical control.

Furthermore, because control is not based on intermittent printing, there is no deviation in the printing position due to gear backlash, and depending on the temperature environment of the printer 2, there is no need to wait for the heat elements 262 to reach the target printing temperature, and the printer controller 20 can reliably prevent a drop in print quality.

As described above, when the printer controller 20 receives a non-image data definition command continuously to an execute printing command IJC, the printer controller 20 prints an image based on the image data stored in the multiple line buffer 253 by the thermal line head 261. As a result, the printer controller 20 can store image data to the multiple line buffer 253 until a non-image data definition command is received. Therefore, the printer controller 20 print multiple image data stored in the multiple line buffer 253 in a single continuous operation, and can prevent intermittent printing when printing an image.

As also described above, when printing an image based on image data stored in the multiple line buffer 253 by the thermal line head 261, the printer controller 20 resets the count of the counter 201. In other words, the printer controller 20 resets the count of the number of times an execute printing command IJC is received. As a result, the printer controller 20 can accurately determine whether or not consecutive execute printing commands IJC are received, and when next printing an image, can reliably prevent printing stopping temporarily.

As also described above, the printer controller 20 sets the operating mode to the batch print mode when printing an image, and printing otherwise, sets the operating mode to the normal print mode.

In this way, by changing the operating mode according to whether or not the object to print is an image, the printer controller 20 has the following effect.

In general, when printing multiple lines of text, there is a specific margin between one line and the next line. Therefore, even of intermittent printing occurs when printing a line of text, the probability that print quality will not drop is high if the white lines occur in the same position as the margin between lines. However, white lines in an image are conspicuous, degrade the appearance of the image, and can reduce print quality. If images and text are printed in the continuous print mode, printing line by line is prevented, intermittent printing does not occur, and white lines can be prevented. However, data including data with a high probability of the print quality not dropping even if intermittent printing occurs is also stored in the continuous print mode.

Therefore, by setting the operating mode to the batch print mode when printing an image, and setting the operating mode to the normal print mode for other printing, the printer controller 20 prevents storing unnecessary data, and can prevent a drop in the print quality of images.

By preventing storing unnecessary data, the number of times data is stored at least to the multiple line buffer 253 is reduced, and deterioration of the multiple line buffer 253 can be slowed.

Furthermore, because data is accumulated in the multiple line buffer 253 in the continuous print mode, printing does not start more quickly than when printing using the line buffer 252. Therefore, by setting the operating mode to the batch print mode when printing an image, and setting the operating mode to the normal print mode for other printing, the printer controller 20 can prevent a drop in the print quality of images and can start printing more quickly.

As also described above, the printer 2 (printing device) has a printer communicator 24 (receiver) configured to receive commands; a thermal line head 261 (line head) that prints line by line on thermal roll paper R (print medium); a multiple line buffer 253 (storage device); and a printer controller 20 (controller) configured to control the thermal line head 261 to execute printing.

When the printer communicator 24 receives an image printing command IC (first command) instructing printing an image, the printer controller 20 stores the image data specified by the image printing command IC to the multiple line buffer 253; and when the printer communicator 24 receives a non-image data definition command (second command), prints an image on the thermal roll paper R by the thermal line head 261 based on the image data stored in the multiple line buffer 253.

In this configuration, when the printer controller 20 stores image data in the multiple line buffer 253 when an image printing command IC is received, and then receives a non-image data definition command, the printer controller 20 can, by the simple control of printing the image data stored in the multiple line buffer 253, prevent printing from stopping temporarily when printing an image, and can suppress a drop in print quality.

An image printing command IC includes an image data definition command GIC containing image data, and an execute printing command IJC instructing executing printing. The printer controller 20 is configured to count the number of times an execute printing command IJC is received by the printer communicator 24, and when number of times an execute printing command IJC is received is 1, does not print by the thermal line head 261.

Thus comprised, because the printer controller 20 does not print by the thermal line head 261 when the number of times an execute printing command IJC is received is 1, multiple instances of image data can be stored in the multiple line buffer 253, and when an image is printed, printing stopping temporarily can be prevented.

Furthermore, when the number of times an execute printing command IJC is received is 2 or more, the printer controller 20 prints an image by the thermal line head 261 on the thermal roll paper R based on the image data stored in the multiple line buffer 253.

Thus comprised, because an image based on the image data stored in the multiple line buffer 253 is printed when the number of times an execute printing command IJC is received is 2 or more and a non-image data definition command is received, the printer controller 20 can store a batch of image data until a non-image data definition command is received, and when printing an image, printing stopping temporarily can be prevented.

Furthermore, the printer controller 20 resets the count of the number of times an execute printing command IJC was received when printing an image on thermal roll paper R by the thermal line head 261 based on image data stored in the multiple line buffer 253.

Thus comprised, because the printer controller 20 resets the count of the number of times an execute printing command IJC was received when printing an image on the thermal roll paper R by the thermal line head 261, whether or not consecutive execute printing commands IJC were received can be reliably determined, and the next time an image is printed, printing stopping temporarily can be reliably prevented.

When a non-image data definition command is received consecutively to an execute printing command IJC, the printer controller 20 prints an image on thermal roll paper R by the thermal line head 261 based on image data stored in the multiple line buffer 253.

Thus comprised, image data can be stored continuously to the multiple line buffer 253 until an execute printing command IJC is received continuously to an execute printing command IJC, or until a non-image data definition command that is not an execute printing command IJC is received continuously to an execute printing command IJC, and the printer controller 20 can prevent printing stopping temporarily when printing an image.

A non-image data definition command is a command not including at least an image data definition command GIC.

Thus comprised, the printer controller 20 can print image data stored in a multiple line buffer 253 controlled simply by receiving a command not containing image data.

The printer controller 20 can execute a normal print mode (normal mode) for storing drive data (data for printing) for one line in a line buffer 252 (storage device), and printing the drive data by the thermal line head 261; and a batch print mode for storing drive data for multiple lines in a multiple line buffer 253, and printing the drive data by the thermal line head 261.

When the printer controller 20 receives an image printing command IC by the printer communicator 24, the printer controller 20 goes to the batch print mode, and stores the image data specified by the image printing command IC to the multiple line buffer 253; and goes from the batch print mode to the normal print mode when a non-image data definition command is received to print image data stored in the multiple line buffer 253 by the thermal line head 261.

Thus comprised, the printer controller 20, by setting the operating mode to the batch print mode when printing an image, and setting the operating mode to the normal print mode for other printing, prevents storing unnecessary data, and can prevent a drop in the print quality of images.

The thermal line head 261 forms images by applying heat to the thermal roll paper R.

Thus comprised, producing white lines in an image can be prevented because printing stopping temporarily when printing an image can be prevented.

The invention is described above with reference to a preferred embodiment thereof, but the invention is not limited thereto and can be modified and adapted in many ways without departing from the scope of the accompanying claims.

For example, when the control method of the printer 2 described above (control method of a printing device) is executed by a computer of the printer 2, the invention may be configured as a program a computer runs to execute the control method, by a storage medium storing the program readably by a computer, or by a communication medium for transmitting the program. The recording medium may also be a magnetic or optical recording medium, or a semiconductor memory device, for example. More specifically, the recording medium may be a removable medium such as a floppy disk, a HDD (Hard Disk Drive), CD-ROM (Compact Disk Read Only Memory), DVD (Digital Versatile Disk), Blu-ray® Disc, magneto-optical disc, flash memory, or memory card media, or a fixed recording medium. The recording medium may also be a nonvolatile memory device such as a hard disk drive, ROM (read-only memory), or other internal storage device of the printer 2.

The function blocks described with reference to FIG. 1 are grouped according to the main content of the processes of the functional configurations of the devices to facilitate understanding the invention. The configuration of the devices may be divided into further elements according to the process content. A single functional element may also be configured to execute more processes. The processes of the component elements may also be executed by a single hardware component, or by multiple hardware components. Yet further, the processes of the component elements may be embodied by a single program, or by multiple programs.

The process units of the flow charts shown in FIG. 4 are divided according to the main content of the processes in order to facilitate understanding the processes of individual devices. The invention is not limited by the method of segmenting or naming the processing units. The processes of the printer 2 can be further divided, according to the process content, into more processing units. Alternatively, single processing units may be further divided into more processing units. Yet further, if the equivalent process can be executed, the order of the processes (steps) in the accompanying flow charts is also not limited to that shown in the figures.

A command instructing a line feed is used as an example of an execute printing command IJC in the foregoing embodiment. However, an execute printing command IJC is not limited to this command.

In addition, the printer 2 in the foregoing embodiment is described as a thermal printer having a thermal line head 261 and configured to print text and images by applying heat to a thermal roll paper R. However, the printer 2 is not limited to thermal printers, and the invention can be applied to any type of printer with which intermittent printing may occur.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printing device connectable to a host computer, the printing device comprising:

a receiver configured to receive, from the host computer, image printing commands, each of the image printing commands including an image data definition command and an execute printing command in order, the image data definition command including image data of an image segment that is divided from a whole image and a data count that stores a data length of the image data of the image segment, the execute printing command instructing executing printing the image segment and a line feed;

a conveyance roller configured to convey a thermal roll paper in a conveyance direction;

a thermal line head configured to print the whole image, line by line, on the thermal roll paper conveyed in the conveyance direction based on the image data of the image segment and the execute printing command that are included in each of the image printing commands;

a cutter configured to cut the thermal roll paper on which the whole image is printed by the thermal line head; and a controller configured to control the thermal line head and the cutter, in response to the receiver receiving, from the host computer, each of the image printing commands before the receiver receives execute printing commands two times in a row, the controller storing the image data of the image segment that is included in each of the image printing commands to a storage device without causing, based on the execute printing command, the thermal line head to print the image data of the image segment that is included in each of the image printing commands, without causing the conveyance roller to execute the line feed based on the execute printing command, and without causing the cutter to cut the thermal roll paper, and in response to the receiver receiving, from the host computer, the execute printing commands two times in a row, the controller controlling the thermal line head to start printing the whole image on the thermal roll paper conveyed in the conveyance direction based on the image data of the image segment that is included in each of the image printing commands and has been stored in the storage device.

2. The printing device described in claim 1, wherein:

the controller is configured to count a number of times the execute printing command is received by the receiver, and does not print by the thermal line head when the number of times the execute printing command was received is one time.

3. The printing device described in claim 2, wherein:

when the number of times the execute printing command was received is two times or more, the controller prints the whole image on the thermal roll paper by the thermal line head based on the image data stored in the storage device.

4. The printing device described in claim 2, wherein:

when printing the whole image on the thermal roll paper by the thermal line head based on the image data stored in the storage device, the controller resets the count of the number of times the execute printing command was received.

5. The printing device described in claim 2, wherein:

the controller is configured to execute a normal mode to store data for printing one line to the storage device, and print the data for printing by the thermal line head, and a batch print mode to store data for printing multiple lines to the storage device, and print the data for printing by the thermal line head;

when the receiver receives the image printing commands, go to the batch print mode and store the image data to the storage device, and when the receiver receives the execute printing commands, print the image data stored in the storage device by the thermal line head, and then change from the batch print mode to the normal mode.

6. The printing device described in claim 1, wherein:

the thermal line head is configured to form an image by applying heat to the thermal roll paper.

7. A control method of a printing device connectable to a host computer, the printing device including a receiver, a conveyance roller configured to convey a thermal roll paper in a conveyance direction, a thermal line head configured to print line by line on the thermal roll paper conveyed in the conveyance direction and a cutter configured to cut the thermal roll paper, the control method comprising:

receiving, by the receiver from the host computer, image printing commands, each of the image printing commands including an image data definition command and an execute printing command in order, the image data definition command including image data of an image segment that is divided from a whole image and a data count that stores a data length of the image data of the image segment, the execute printing command instructing executing printing the image segment and a line feed;

storing the image data of the image segment that is included in each of the image printing commands to a storage device without causing, based on the execute printing command, the thermal line head to print the image data of the image segment that is included in each of the image printing commands, without causing the conveyance roller to execute the line feed based on the execute printing command, and without causing the cutter to cut the thermal roll paper in response to the receiver receiving, from the host computer, each of the image printing commands before the receiver receives execute printing commands two times in a row;

starting printing the whole image on the thermal roll paper conveyed in the conveyance direction by the thermal line head based on the image data of the image segment that is included in each of the image printing commands and has been stored in the storage device in response to the receiver receiving, from the host computer, the execute printing commands two times in a row; and cutting, by the cutter, the thermal roll paper on which the whole image is printed by the thermal line head.

8. The printing device described in claim 1, wherein:

when the receiver has received, from the host computer, the image printing commands, the controller stores the image data to the storage device without printing an image by the thermal line head, and the controller is configured to count a number of times the execute printing command has been received by the receiver and continue to store the image data to the storage device without printing the image until the number of times the execute printing command has been received is two times or more.

* * * * *